US009201335B2

(12) United States Patent
Judd et al.

(10) Patent No.: US 9,201,335 B2
(45) Date of Patent: Dec. 1, 2015

(54) DYNAMIC ADJUSTABLE FOCUS FOR LED WRITING BARS USING PIEZOELECTRIC STACKS

(71) Applicant: XEROX CORPORATION, Norwalk, CT (US)

(72) Inventors: Derek William Judd, Hertfordshire (GB); Brian Noel Reid, Hertfordshire (GB); Michael John Wilsher, Herts (GB)

(73) Assignee: Xerox Corporation, Norwalk, CT (US)

( * ) Notice: Subject to any disclaimer, the term of this patent is extended or adjusted under 35 U.S.C. 154(b) by 34 days.

(21) Appl. No.: 14/086,829

(22) Filed: Nov. 21, 2013

(65) Prior Publication Data

US 2015/0138296 A1 May 21, 2015

(51) Int. Cl.
*G03G 15/04* (2006.01)

(52) U.S. Cl.
CPC ..... *G03G 15/04054* (2013.01)

(58) Field of Classification Search
CPC .... G03G 15/04; G03G 15/04054; B41J 2/385
See application file for complete search history.

(56) References Cited

U.S. PATENT DOCUMENTS 5,703,860 A * 12/1997 Fukunaga et al. ..... 369/102

* cited by examiner

*Primary Examiner* — Sarah Al Hashimi
(74) *Attorney, Agent, or Firm* — Ronald E. Prass, Jr.; Prass LLP

(57) ABSTRACT

According to aspects of the embodiments, there is provided methods of dynamically focusing an LED print bar or printhead using piezoelectric stacks. The stack is mounted on either end of the LED bar to adjust the focus of the bar against the photoreceptor surface. The piezo level could be either controlled through active feedback of some description such as optical or electrical, or as a service or manufacturing input. With electronic control, focus adjustments can be made by the machine, and dynamically, if needed. In one embodiment, a flextensional cell structure is employed to amplify the movement of the piezo stack to move the LED bar in the order of >50 microns closer or away from the photoreceptor surface.

7 Claims, 6 Drawing Sheets

DYNAMIC ADJUSTABLE FOCUS FOR LED WRITING BARS USING PIEZOELECTRIC STACKS

BACKGROUND

The disclosure relates generally to electrophotographic printer systems, and more particularly the dynamic focusing of an exposure device using piezoelectric stacks mounted on ether end of an LED bar to adjust the focus of the bar against the photoreceptor surface.

Print bar type imager assemblies consist of an array, usually linear, of individual sources. These print bars are typically made up of smaller sub-arrays butted side by side to make a longer array. A "print bar" as used in this document means a structure or device holding an arrangement of printheads that remains stationary during printing. For print bars or printheads the prevalent technology currently is the light emitting diode ("LED") bar. A lens mechanism such as a rod lens array (commercially available under the trademarked name SELFOC) can be used in the print bar for focusing the light emitted by the LEDs on the photosensitive recording member such as a photoreceptor (P/R) medium. However, due to the limitations and tolerances of the lens mechanism, the depth of focus of a Selfoc lens is very small. Depth of focus is the tolerance in which either the light source, the Selfoc lens or photoreceptor can have a positional error (around ±60 μm) with respect to the other two without losing the focus. Moving out of this focus range results in imaging defects, see FIG. 3. To maintain this mechanical tolerance (around ±60 μm) or to bring the system back in can require adjustment due to production variations, environmental changes or wear over life. This constant adjustment adds to design and production cost. Various techniques have been proposed to address the so called depth of focus problem in electrophotographic printing. Depth of focus correcting techniques have included replacing the light source with a laser, changing the spot size by eliminating the lens mechanism, replacing the light source, and software processing to change the illumination profile of the light source.

There is a need in the art for methods and systems that can optimally control the position of the printbar or printhead to correct for process variations and other factors that may adversely affect the depth of focus or positional errors when forming an image on a photoreceptor medium.

SUMMARY

According to aspects of the embodiments, methods are provided of dynamic focusing of an LED print bar or printhead using piezoelectric stacks. The stack is mounted on either end of the LED bar to adjust the focus along the length of the bar against the photoreceptor surface. The piezo level could be either controlled through active feedback of some description such as optical or electrical, or as a service or manufacturing input. With electronic control, focus adjustments can be made by the machine, and dynamically, if needed. In one embodiment, a flextensional cell structure is employed to amplify the movement of the piezo stack to move the LED bar in the order of greater than 50 microns closer or away from the photoreceptor surface.

DETAILED DESCRIPTION

Figure 1:
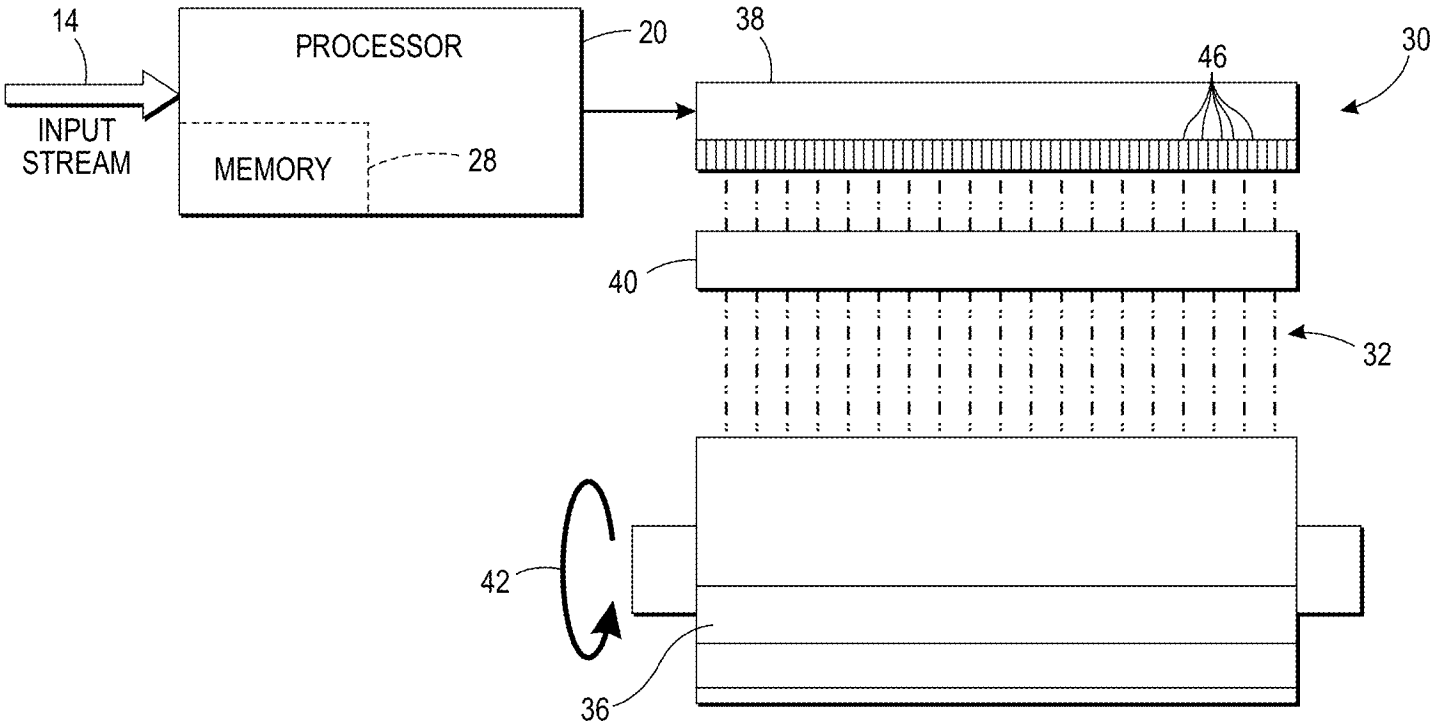
FIG. 1 illustrates a block diagram of a xerographic printer in accordance to an embodiment.

Aspects of the embodiments disclosed herein relate to methods for dynamic focusing of an LED bar using piezoelectric stacks mounted on either end of the LED bar to adjust the focus of the bar against a photoreceptor surface, and corresponding apparatus. The disclosed embodiments also employ flextensional cell structure to amplify the movement of a piezo stack to position and maintain the LED bar at an acceptable focus.

Although embodiments of the invention are not limited in this regard, discussions utilizing terms such as, for example, "processing," "computing," "calculating," "determining," "establishing", "analyzing", "checking", or the like, may refer to operation(s) and/or process(es) of a computer, a computing platform, a computing system, or other electronic computing device, that manipulate and/or transform data represented as physical (e.g., electronic) quantities within the computer's registers and/or memories into other data similarly represented as physical quantities within the computer's registers and/or memories or other information storage medium that may store instructions to perform operations and/or processes.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of stations" may include two or more stations.

Embodiments within the scope of the present disclosure may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions.

Computer-executable instructions also include program modules that are executed by computers in stand-alone or network environments. Generally, program modules include routines, programs, objects, components, and data structures, etc. that performs particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

The disclosed embodiments include a printing system comprising a light source having a plurality of light emitting elements for emitting a plurality of light beams to a photoreceptor medium, wherein the light source is located at a distance (D) from the photoreceptor medium in such a manner that each light beam strikes the photoreceptor medium at a spot to form an image; and a piezo actuating system to produce fine adjustments to the distance between the light source and the photoreceptor medium by moving the light source towards or away from the photoreceptor medium, the piezo actuating system including a piezo driver and at least one piezo stack; wherein the at least one piezo stack enables bidirectional motion of the light source as the at least one piezo stack expands and contracts under a changing applied actuation signal.

The disclosed embodiments further include a method comprising using a piezo actuating system to produce fine adjustments to a distance between a light source and a photoreceptor medium by moving the light source towards or away from the photoreceptor medium, the piezo actuating system including a piezo driver and at least one piezo stack; wherein the light source comprises a plurality of light emitting elements for emitting a plurality of light beams to the photoreceptor medium, wherein the distance (D) from the photoreceptor medium to the light source is such that each light beam strikes the photoreceptor medium at a spot to form an image; wherein the at least one piezo stack enables bidirectional motion of the light source as the at least one piezo stack expands and contracts under a changing applied actuation signal.

In accordance with another aspect of the embodiments, the method further includes wherein the piezo actuating system can increase or decrease the distance between the LED bar and the photoreceptor medium by at least 25 microns; and wherein the piezo actuating system further comprises a flextensional cell structure that receives an input force from at least one piezo stack along a first axis and provides an output force along a second axis that is amplified compared to the first input force.

The disclosed embodiments further include an apparatus to adjust the focus of an LED bar against a photoreceptor medium by moving the LED bar bi-directionally along constrained paths, the apparatus comprising an LED bar positioned at an initial distance (ID) from the photoreceptor medium in such a manner that each light beam strikes the photoreceptor medium at a spot to form an image; a flextensional cell structure connected to the LED bar and at least one piezo stack to amplifying the movement of the at least one piezo stack to selectively position the LED bar at any desired location between an outer distance and an inner distance from the initial distance (ID); a controller to apply a voltage across the at least one piezo stack to cause flextensional movement of the at least one piezo stack to translate the LED bar between the outer distance and the inner distance.

As used herein, the term "flextensional movement" is displacement resulting from the extensional motion of at least one mover such as an actuator.

As used herein, the term "conjugate length" is the distance from an imaging drum or image surface to a print bar surface such as an LEB bar.

FIG. 1 illustrates a block diagram of a xerographic printer in accordance to an embodiment. The xerographic print engine receives a data source like input stream 14 supplying pixels that represent an image. The input stream 14 is optionally held in a buffer such memory 28 before processing by an image rendering processor 20. After all processing of the stream and other rendering is applied a data stream corresponding to desired light pulses is supplied to imaging optics 30. Here, optics 30 are configured to scan a data modulated light beam 32 over a xerographic photoreceptor 36. To that end, an LED bar or LED array 38 selectively generates a light beam 32 in the visible or invisible (e.g., infra-red) band of the spectrum. Projection optics or imaging optical element 40 focus light 32 onto selected areas of the photoreceptor 36. A conventional imaging optical element is a Selfoc lens array. A Selfoc lens array is an array of micro-lenses which will be placed between the light bar and the photoreceptor. A major disadvantage of Selfoc lens is that they have a very poor depth of focus.

More particularly, the image bar 38 is composed of a linear array of individually addressable LEDs 46 that are distributed widthwise of the photoreceptor 36 on generally uniformly spaced centers for sequentially exposing the photoreceptor 36 to successive lines of an image as the photoreceptor 36 is being advanced by a motor or the like in an orthogonal process direction.

In the illustrated embodiment, the LED array 38 is disposed across the photoreceptor 36 in the fast scan direction. The photoreceptor 36 is advanced (device not shown) in an orthogonal, process direction at a substantially constant linear velocity, as indicated by the arrow 42, so the array of beams 32 exposes the photoreceptor 36 in successive raster-like scan lines. As shown, the photoreceptor 36 is coated on a rotating drum, but it will be apparent that it also could be carried by a belt or any other suitable substrate.

To carry out the present invention, the processor 20, hence the light beam 32 variably exposes the photoreceptor 36. Processor 20 may include at least one conventional processor or microprocessor that interprets and executes instructions. The processor 20 may be a general purpose processor or a special purpose integrated circuit, such as an ASIC, and may include more than one processor section. Additionally, the xerographic printer may include a plurality of processors 20.

Memory 28 may be a random access memory (RAM) or another type of dynamic storage device that stores information and instructions for execution by processor 20. Memory 28 may also include a read-only memory (ROM) which may include a conventional ROM device or another type of static storage device that stores static information and instructions for processor 20. The memory 28 may be any memory device that stores data for use by xerographic printer or controller.

The controller may perform functions in response to processor 20 by executing sequences of instructions or instruction sets contained in a computer-readable medium, such as, for example, memory 28. Such instructions may be read into memory 28 from another computer-readable medium, such as a storage device, or from a separate device via a communication interface, or may be downloaded from an external source such as the Internet.

Figure 2:
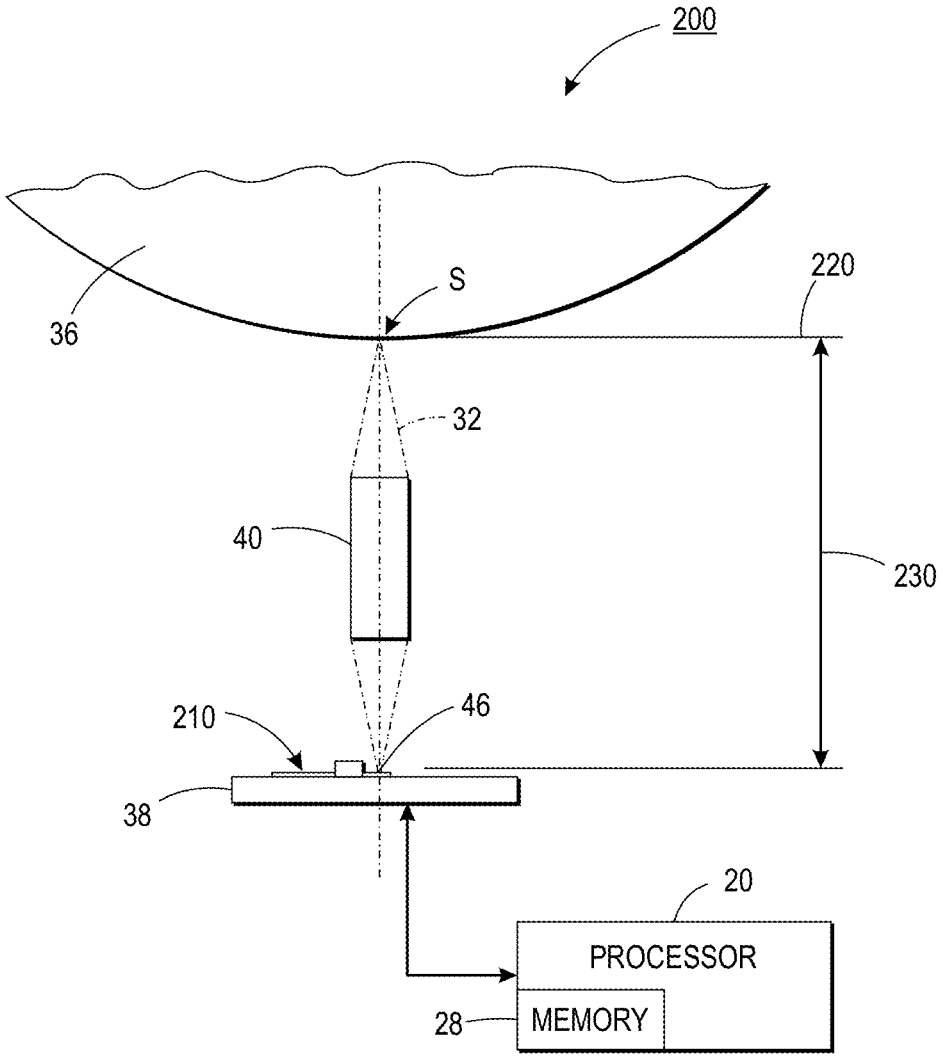
FIG. 2 illustrates an exposure device with LED bar and rod lens array in accordance to an embodiment.

FIG. 2 illustrates an exposure device with LED bar and rod lens array 200 in accordance to an embodiment. As shown in FIG. 2, a photoreceptor 36 is placed/positioned at a conjugate length (typically in the range of 5 mm to 11 mm) or distance (D) 230 from the print bar, the light beam 32 from the LED bar 38 will generate a series of spots (S) each with a spot size at an image plane on photoreceptor 36. However, distance variability and manufacturing errors in the lens surface cause a symmetrical aberration with respect to the optical axis on an image formation plane, resulting in a considerable deterioration in image formation performance. To compensate the conjugate length has to be adjusted. The distance variability moves the image out-of-focus at the photoreceptor. If the spot is not in focus then the distance 230 would have to be adjusted until the spot is in focus. The LED bar comprises a substrate on which a number of LED chips with LEDs 46 and LED drivers 210 is disposed, and a rod lens array 40. A single LED chip may be provided with a large number of LEDs. A non-volatile memory such as memory 28 is provided for storing a list (Look-up table or LUT) comprising the setting values for the energy output level for driving each individual LED and value for at least one piezo stack (piezo actuator) that is used to bring the spot into focus with processor 20 as explained in FIG. 4. The rod lens array 40 is used to concentrate the light emitted by the LEDs 46 on the photosensitive recording member such as photoreceptor medium 36.

Figure 3:
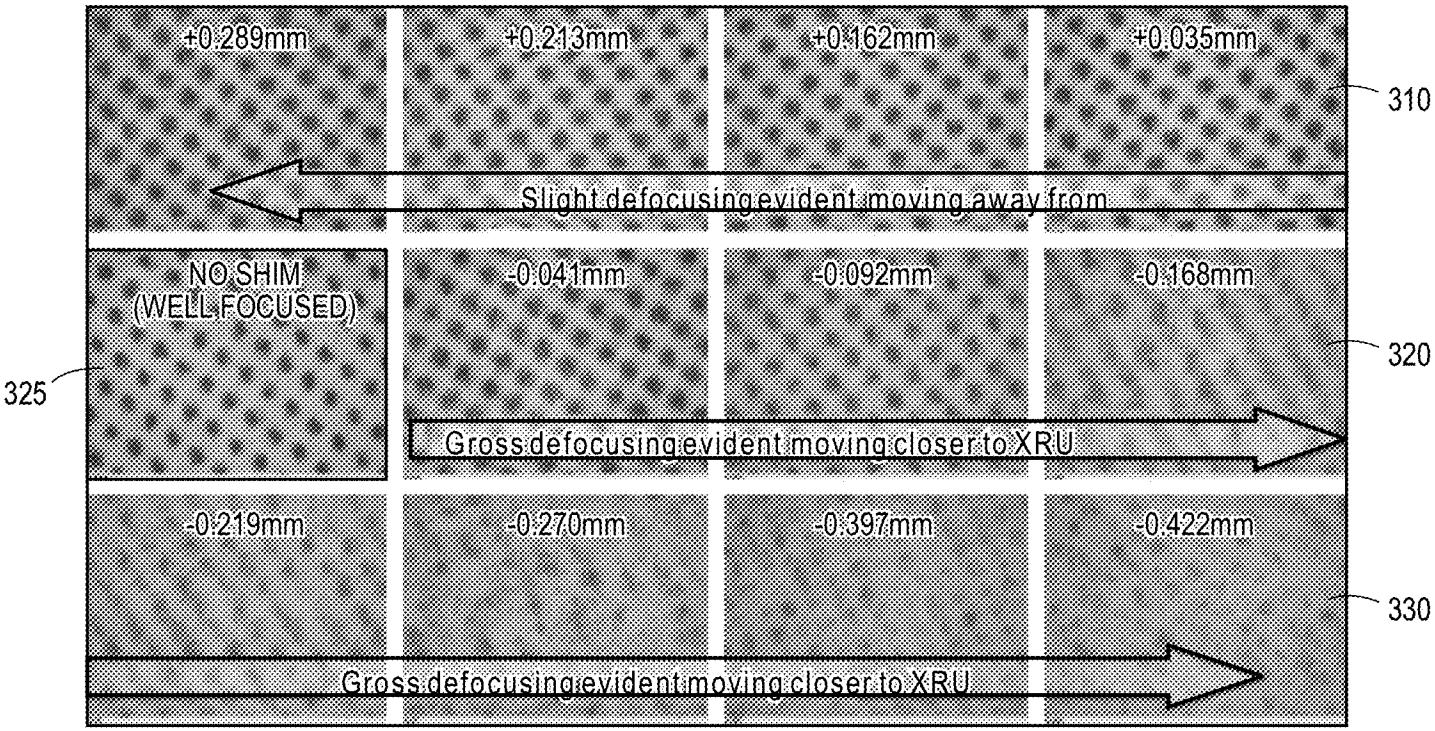
FIG. 3 illustrates a diagram of the effects of change in focus of LED bar in accordance to an embodiment.

FIG. 3 illustrates a diagram of the effects of change in focus of LED bar in accordance to an embodiment. Panel 310 shows the focusing effect of moving the LED bar 38 away from the photoreceptor 36, i.e., increasing the initial distance, by the range of 0.035 mm (35 Microns) to 0.289 mm (289 Microns). As can be seeing from panel 310 there is a slight defocusing when the distance increases. Panel 320 shows the effect of moving the light source LED bar towards the photoreceptor. As can be seen the initial distance as evidence by tile 325 was already properly focused. In panel 320 the distance was decreased by the range −0.041 mm (41 Microns) to −0.168 mm (168 Microns). As can be seen, there is gross defocusing evident moving closer to the XRU like photoreceptor. Panel 330 is another example of moving the LED bar closer to the photoreceptor. As can be seen from FIG. 3 an operator could shim the distance or adjust with a mechanical screw (see panel 325) to correct for variation in the mechanical mounting system. However, such adjustments to image focusing would increase manufacturing process time and due to errors in adjustments could result in a reduction to print quality.

Figure 4:
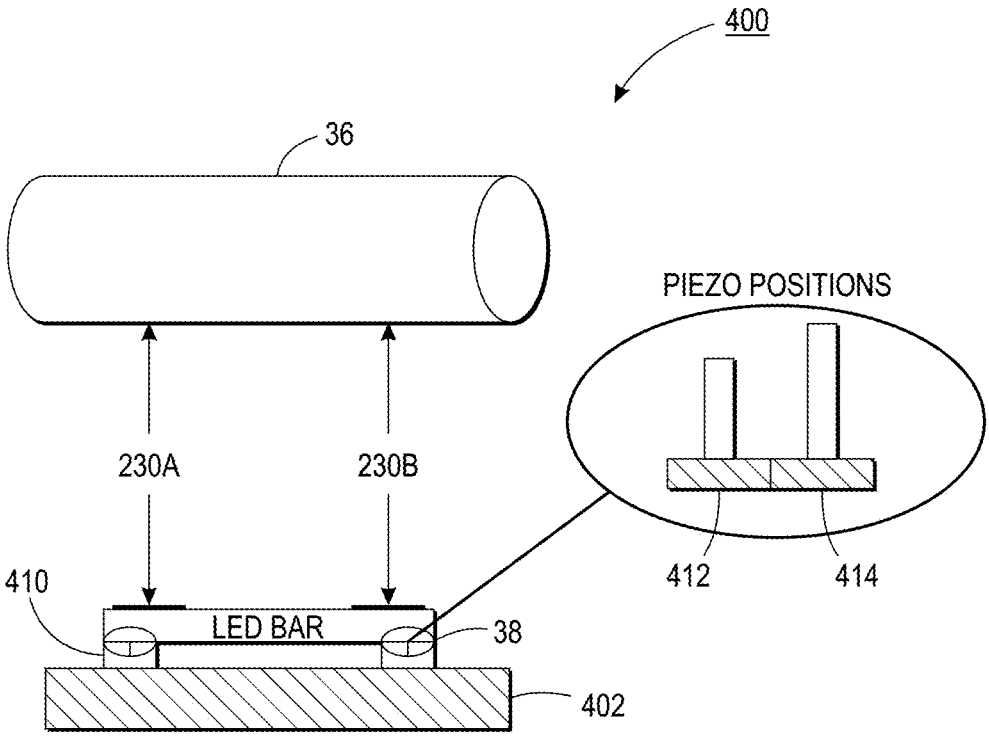
FIG. 4 diagrammatically illustrates the arrangement of an exposure device with dynamic focusing of the LED using piezoelectric stacks mounted on either end of the LED bar in accordance to an embodiment.

FIG. 4 diagrammatically illustrates the arrangement of an exposure device with a piezo actuator 400 to dynamically focus the LED using piezoelectric stacks mounted on either end of the LED bar in accordance to an embodiment. In particular, FIG. 4 illustrates an LED bar 38 sitting on a piece of lengthening material or piezo stack 410 positioned on a base material 402. While the base material 402 represents the simplest embodiment showing the desired effect, it will be appreciated that many other shapes are possible for the base material 402, e.g., rectangles, rhombuses, triangles and the like. Thus, LED bar 38 can be placed at various configurations/angles from the photoreceptor. The piezo stack 410 can be positioned at either end to dynamically change the LED bar to photoreceptor distance shown as 230A and 230B. A method is then used to determine the best focus at each end independently, i.e., a piezo stack for distance 230A or a piezo stack for distance 230B. The piezo stack 410 is made of a stack of piezoelectric elements. The piezoelectric elements expand or contract through the piezoelectric effect. The piezoelectric elements position the LED bar at any desired location between an outer distance and an inner distance from the initial distance which is any prior distance preceding an applied actuation signal to the element. The piezo stack 410 converts an electric signal transmitted thereto into a mechanical signal using the piezoelectric material such as lead zirconate titanate (PZT), thus providing actuating force for transferring the LED bar 38 to various conjugate lengths. The piezo stack 410 expands 414 and contracts 412, thus applying the actuating force to the LED bar 36. A typical length change (412 & 414) value for a piezoelectric element, which is in the direction of the applied field, might be 0.1 percent (0.1%) of the total piezo material length. For example, when actuated, a 1 mm thick layer of PZT will increase in thickness by one (1) micron. Since the range of motion for proper focusing of the LED bar 38 is in the range of ±30 μm to 100 microns (μm) it would require at least 100 PZT elements, each having a port for actuation, to maintain the LED bar in focus. In order to enhance the mechanical motion of the piezo stack to obtain high displacement, large mechanical load capability and high displacement height ration with low applied voltage for actuator transducer, a secondary amplification of mechanical amplification can be incorporated into the system. Mechanical amplification can take the form of triangle amplification, X-Frame amplification, Double X-Frame amplification, L-L mechanical amplification, flextensional amplification, and articulated frame amplification.

Figure 5:
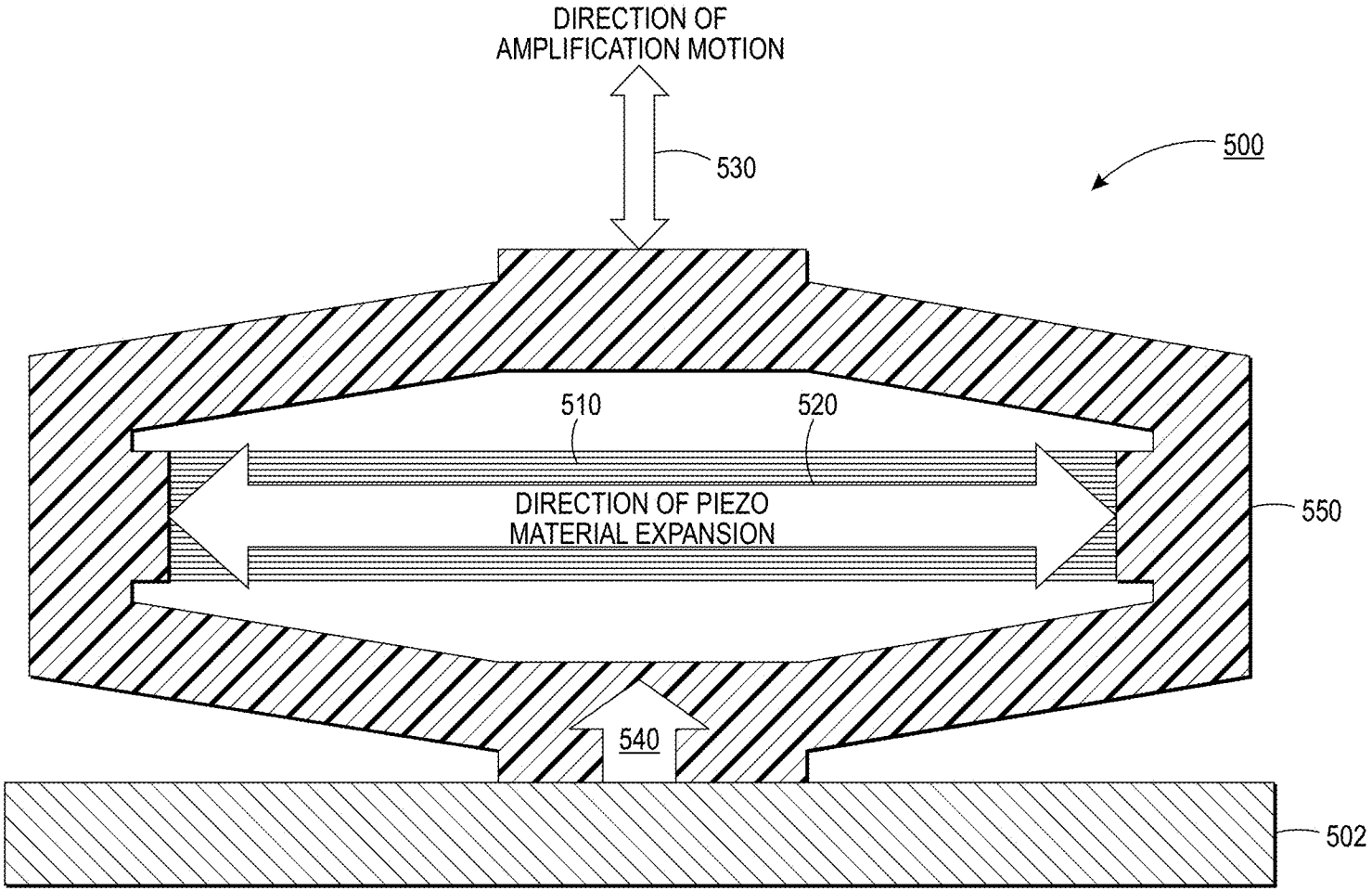
FIG. 5 is an illustration of a piezo stack with mechanical amplification in accordance to an embodiment.

FIG. 5 is an illustration of a piezo actuator 500 with mechanical amplification in accordance to an embodiment. Piezo actuator 500 comprises at least one piezo stack 510 inside an outer flextensional casing 550. The flextensional casing 550 comprises links or blocks connected by thin metal webs called flexures. The flexures act like frictionless hinges to amplify an input force. An actuator with amplification such as piezo actuator 500 provides nanometer precision, fast response and travel ranges to 250 μm and more. Piezo stack 510 is the same as piezo stack 410 of FIG. 4; a different number is given to denote a different configuration or axis of movement. In this configuration the input force of the piezo stack 510 is from left (contracts) to right (expands). A rotation of piezo actuator by ninety degrees (90°) would still be the same piezo material but now the force will be in a different axis. As shown, piezo material compression or expansion from piezo stack 510 acts as an input force ($F_x$) 520 to the cell structure, an amplified force ($F_y$) 530 is exerted in the direction of the LED bar (not shown). Some of the amplified force is absorbed by the base material 502 as shown by reaction force 540. As the actuation voltage applied to the piezo stack increases, piezo flextensional movement causes the flextensional cell structure to expand outward. Over the full rated voltage range of the piezo stack, the actuator typically achieves a nominal displacement range of at least 100 microns. This level of motion results from the amplification of the piezo stack's output motion of approximately 20 microns. The piezo stack can also be driven to a small negative voltage. Under a negative voltage, the piezo material actually contracts. The normally expanding piezo-actuator retracts when a negative voltage is applied.

Figure 6:
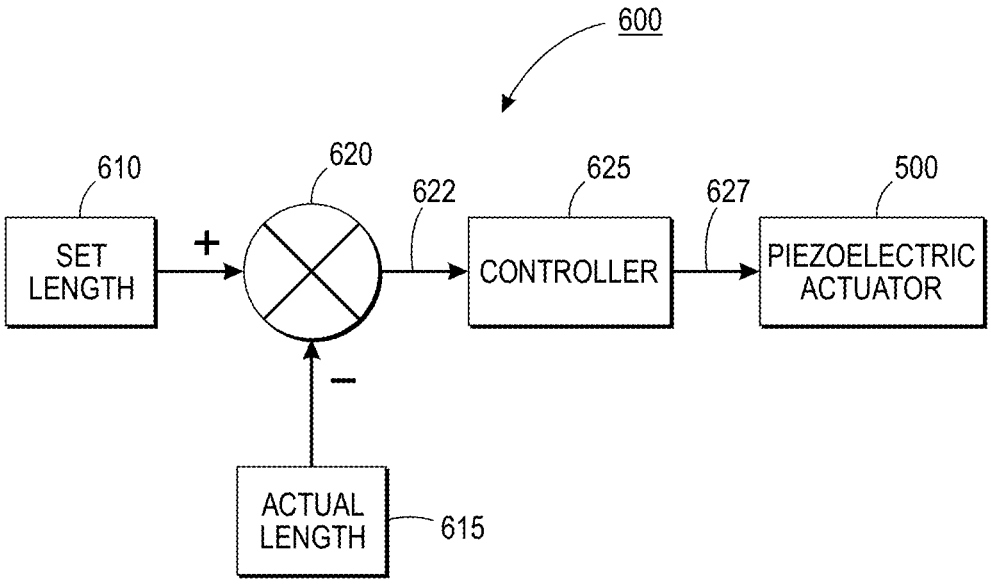
FIG. 6 illustrates dynamic focusing by controlling piezo stacks in accordance to an embodiment.

FIG. 6 illustrates dynamic focusing 600 by controlling piezo stacks in accordance to an embodiment. The illustrated embodiment is to the piezo level being controlled through active feedback of some description (e.g. optical or electrical) on the medium. As used herein the length is the conjugate length between the LED bar and the photoreceptor medium at the point where the imaging plane is formed. The conjugate length is the same as distance (D) (230 in FIG. 2) and as such is interchangeable for the purpose of this description.

A set length generator 610, such as a non-volatile memory voltage value or an (actuation) voltage signal, outputs a desired position for the LED bar. This position is the conjugate length of the LED bar relative to the medium such as the XRU. It should be noted that the output position may be a continuous series of positions representing a smooth trajectory from a current position to a desired target position.

The output of the set length generator 610 is input into a subtractor 620. The subtractor 620 is also provided with an actual length signal 615. The actual length signal 615 represents the actual position of the object to be moved by the position control system. A sensor (not shown) may be mounted on the LED bar to measure the distance from the photoreceptor using various techniques known to those of ordinary skill in the field of imaging devices. The actual length signal 615 is subtracted from the desired length and a length error signal 622 is output by the subtractor. The length error signal 622 represents the amount by which the LED bar is out-of-focus.

The amount that the LED bar is out-of-focus, i.e., the length error signal 622, can be ascertained through different techniques. In a first method, an estimate of the out-of-focus distances within a scanned image by using two versions, i.e. two test pages, of an image reproduced at a known, predetermined, or measurable difference in optical path length between the two scans, or using a calibration scan of similar content (e.g., text) at a known defocus distance. In a second method, a sensor (not shown) may be mounted on the LED bar to measure the distance from the photoreceptor using various techniques known to those of ordinary skill in the field of imaging devices and the output of the sensor is subtracted from a value of what the length should be for the printing system. A third and final method for determining the out-of-focus distance is a service or a manufacturing input from analysis of the printing of a test sheet which would allow manufacturing or technical representative to adjust the piezo driver by changing an NVM independently for each end of the piezo stack.

The length error signal 622 is input into a controller 625. The services of controller 625 can be performed by processor 20 or by a general purpose computer which is a well-known system in the art. Based on the length error signal 622, the controller 625 determines a length controller force signal (LCFS) 627. The LCFS 627 is output to an actuator system like piezo actuator 500 or 400. The actuator system exerts a force and thus moves the object corresponding to the LCFS 627. For example, if the actuator system is a piezo actuator system such as described in relation to FIGS. 5, the LCFS 627 may represent a number of voltages supplied over a corresponding number of conducting leads, each voltage controlling each piezo stack comprised by the flextensional casing than can amplify the force of the piezo stack. If the flextensional cell can amplify an input force (IF) by a factor of ten (10*IF) and there are four piezo stacks each capable of expanding two (2) microns (4*2=8 microns) then the overall expansion can be 200 microns. In the event that an out-of-focus length is only twenty (20) microns then the controller 625 can apply the LCFS 627 providing a single voltage to one piezo stack or to a combination of the four piezo stacks provided that the overall movement of the LED bar is 20 microns. It should be understood that any other actuator configuration maybe used in this length control circuit and thus the LCHS 627 may have any suitable form.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A printing system comprising:

a light source having a plurality of light emitting elements for emitting a plurality of light beams to a photoreceptor medium, wherein the light source is located at a distance (D) from the photoreceptor medium in such a manner that each light beam strikes the photoreceptor medium at a spot to form an image;

a piezo actuating system to produce fine adjustments to the distance between the light source and the photoreceptor medium by moving the light source towards or away from the photoreceptor medium, the piezo actuating system including a piezo driver and at least one piezo stack that provides an actuating force to move the light source to various conjugate lengths; and a flextensional cell structure in the piezo actuating system to amplify along a second axis the actuating force from the at least one piezo stack along a first axis;

wherein the at least one piezo stack using the flextensional cell structure enables bidirectional motion of the light source as the at least one piezo stack expands and contracts under a changing applied actuation signal;

wherein the at least one piezo stack using the flextensional cell structure can increase or decrease the distance between the light source and the photoreceptor medium by at least 25 microns.

2. The printing system of claim 1, wherein the light source is an LED bar and the light emitting elements are light emitting diodes.

3. The printing system of claim 1, wherein the input actuating force is caused by flextensional movement of the at least one piezo stack.

4. The printing system of claim 1, wherein the actuation signal is a voltage value selected from a table of values in a non-volatile memory.

5. A method comprising:

using a piezo actuating system to produce fine adjustments to a distance between a light source and a photoreceptor medium by moving the light source towards or away from the photoreceptor medium, the piezo actuating system including a piezo driver and at least one piezo stack;

wherein the piezo actuating system further comprises a flextensional cell structure that receives an input force from the at least one piezo stack along a first axis and provides an output force along a second axis that is amplified compared to the first input force;

wherein the input force is caused by flextensional movement of the at least one piezo stack;

wherein the light source comprises a plurality of light emitting elements for emitting a plurality of light beams to the photoreceptor medium, wherein the distance (D) from the photoreceptor medium to the light source is such that each light beam strikes the photoreceptor medium at a spot to form an image;

wherein the at least one piezo stack enables bidirectional motion of the light source as the at least one piezo stack expands and contracts under a changing applied actuation signal;

wherein the actuation signal is a voltage value selected from a table of values in a non-volatile memory.

6. The method of claim 5, wherein the light source is an LED bar and the light emitting elements are light emitting diodes.

7. The method of claim 6, wherein the piezo actuating system can increase or decrease the distance between the LED bar and the photoreceptor medium by at least 25 microns.

* * * * *